US009233284B2

(12) United States Patent
Nathan

(10) Patent No.: US 9,233,284 B2
(45) Date of Patent: Jan. 12, 2016

(54) GOLF PUTTER GRIP PATTERN

(71) Applicant: Raghu Nathan, Bossier City, LA (US)

(72) Inventor: Raghu Nathan, Bossier City, LA (US)

( * ) Notice: Subject to any disclaimer, the term of this patent is extended or adjusted under 35 U.S.C. 154(b) by 0 days.

(21) Appl. No.: 14/321,304

(22) Filed: Jul. 1, 2014

(65) Prior Publication Data

US 2015/0005087 A1 Jan. 1, 2015

Related U.S. Application Data

(60) Provisional application No. 61/841,490, filed on Jul. 1, 2013.

(51) Int. Cl.
*A63B 53/14* (2015.01)
*A63B 59/00* (2015.01)

(52) U.S. Cl.
CPC ..... *A63B 53/14* (2013.01); *A63B 59/0025* (2013.01); *A63B 60/08* (2015.10); *A63B 60/10* (2015.10); *A63B 60/12* (2015.10)

(58) Field of Classification Search
CPC .... A63B 53/14; A63B 59/0025; A63B 60/12; A63B 60/10; A63B 60/08
See application file for complete search history.

(56) References Cited

U.S. PATENT DOCUMENTS 1,587,082 A * 6/1926 Mattern ..... 473/201
2,091,512 A * 8/1937 Marsh ..... 473/203
3,848,874 A * 11/1974 Elkins, Jr. ..... 473/409
D336,322 S * 6/1993 Poincenot et al. ..... D21/756
5,348,303 A * 9/1994 Swissheim ..... 473/201
5,427,376 A * 6/1995 Cummings et al. ..... 473/201
5,626,527 A * 5/1997 Eberlein ..... 473/203
5,865,684 A * 2/1999 Herber ..... 473/201
6,022,278 A * 2/2000 Vela ..... 473/201
6,210,289 B1 * 4/2001 LaBrake ..... 473/201
D462,404 S * 9/2002 Huang ..... D21/756
D463,521 S * 9/2002 Jones ..... D21/756
D477,647 S * 7/2003 Kim ..... D21/759
6,656,054 B2 * 12/2003 Ulrich ..... 473/201
D618,296 S * 6/2010 Gill et al. ..... D21/756
D638,503 S * 5/2011 Lidenberg ..... D21/756
D638,504 S * 5/2011 Lidenberg ..... D21/756
8,021,247 B2 * 9/2011 Brolly ..... 473/340
D648,411 S * 11/2011 Lidenberg ..... D21/756
D660,388 S * 5/2012 Gill et al. ..... D21/756
8,267,806 B2 * 9/2012 Karube ..... 473/300
D733,238 S * 6/2015 Bacon et al. ..... D21/756
9,061,188 B2 * 6/2015 Nathan
2002/0187845 A1 * 12/2002 Kim ..... 473/201
2008/0305883 A1 * 12/2008 Cameron ..... 473/300
2009/0011875 A1 * 1/2009 Drake et al. ..... 473/551
2009/0217441 A1 * 9/2009 McCree et al. ..... 2/161.2
2013/0344978 A1 * 12/2013 Huang ..... 473/300
2014/0041794 A1 * 2/2014 Huang ..... 156/192
2014/0066222 A1 * 3/2014 Huang et al. ..... 473/300
2014/0349775 A1 * 11/2014 Davis et al. ..... 473/201
2015/0011324 A1 * 1/2015 Beno et al. ..... 473/223
2015/0099594 A1 * 4/2015 Graham ..... 473/300

* cited by examiner

*Primary Examiner* — Stephen Blau

(57) ABSTRACT

A golf putter grip pattern is disclosed. The golf putter grip has a top end, a bottom end, a substantially flat front portion, a substantially curved rear portion, a first side, and a second side. The first and second sides are in between the front portion and the rear portion. The present invention may further include a pattern disposed on the golf putter grip that aids the golfer in perfecting the golf putter swing.

8 Claims, 3 Drawing Sheets

GOLF PUTTER GRIP PATTERN

CROSS-REFERENCE TO RELATED APPLICATION

This application claims the benefit of priority of U.S. provisional application No. 61/841,490, filed Jul. 1, 2013, the contents of which are herein incorporated by reference.

BACKGROUND OF THE INVENTION

The present invention relates to golf putting and, more particularly, to a golf putter grip pattern.

The correct putting stroke is poorly understood and difficult to execute consistently. Current grip patterns do not provide any landmarks for the X, Y and Z planes of the three dimensional space where the putter operates. For example, the current grips do not provide alignment aids for the loft plane and the swing plane of the putter.

Even small differences in position of a finger or a fingertip can have dramatic consequences on a resulting putt. There are specific requirements on which motor components of the human musculoskeletal system control the loft plane and control the swing plane of the putter during the backswing and through-swing. Failing to provide landmarks for the parts of the hand on the grip that control these planes is a serious deficiency in the patterns that currently exist.

As can be seen, there is a need for an improved golf putter pattern that aids in the putter swing.

SUMMARY OF THE INVENTION

In one aspect of the present invention, an apparatus comprising: a golf putter grip having a top end, a bottom end, a substantially flat front portion, a substantially curved rear portion, a first side, and a second side, wherein the first and second sides are in between the front portion and the rear portion; and a pattern disposed on the golf putter grip, wherein the pattern comprises: a top triangle and a bottom triangle disposed on the front portion, wherein the top triangle and the bottom triangle each comprise a bottom and a pair of sides extending from the bottom and intersecting at a top point, wherein the bottoms are substantially parallel relative to one another; a top line extending from the first side to the rear portion, aligned near the top point of the top triangle; a first diagonal line extending from the bottom side of the top triangle extending onto the first side; a second diagonal line extending from the bottom side of the bottom triangle and extending on to the first side, intersecting with the first diagonal line; a first middle line extending from the intersection of the first diagonal line and the second diagonal line and disposed on the rear portion, wherein the first middle line is substantially parallel with the top line; and a bottom line disposed on the rear portion below and substantially parallel with the first middle line.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a design that may be imprinted on golf putters for promoting the correct putting stroke. The pattern described below may enable the golfer to adopt the correct grip and set up and provide landmarks for ball position, target and correct execution of the putt.

The grip pattern and the technique associated of the present invention are based on the emergent phenomenon of the ideal putting stroke which is a synchronized double pendulum. The present invention provides landmarks for the X, Y and Z plane and landmarks for the parts of the hand that control the loft plane and the swing plane. Adopting the correct grip and executing the correct putting stroke described here will significantly improve the ease and accuracy of putting.

Figure 1:
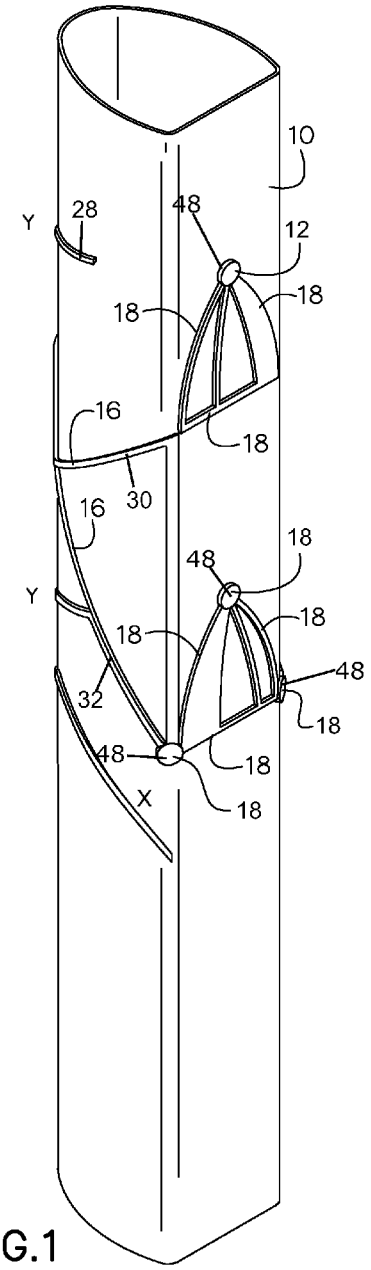
FIG. 1 is a front perspective view of the present invention.
Figure 2:
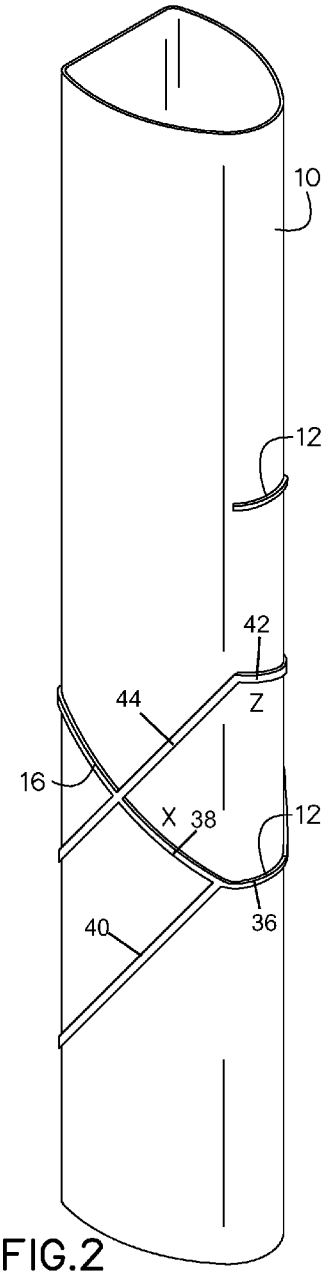
FIG. 2 is a rear perspective view of the present invention.
Figure 3:
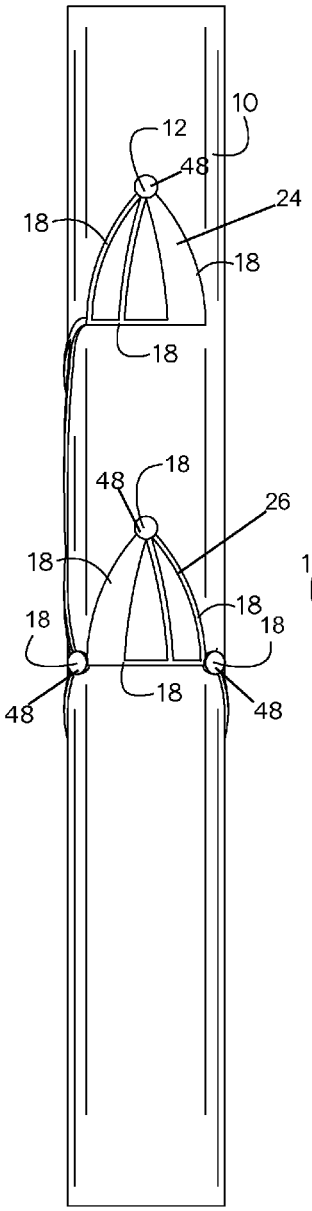
FIG. 3 is a front view of the present invention.
Figure 4:
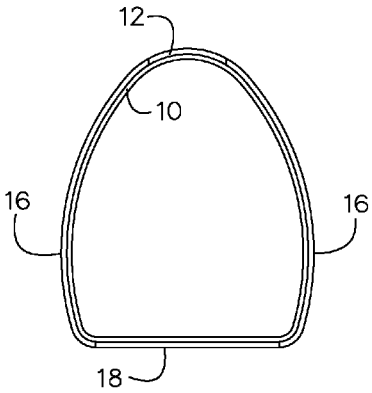
FIG. 4 is a top view of the present invention.
Figure 5:
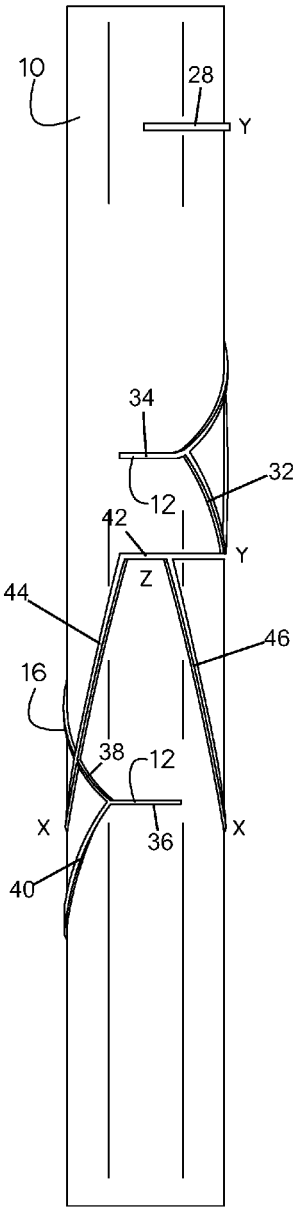
FIG. 5 is a rear view of the present invention.
Figure 6:
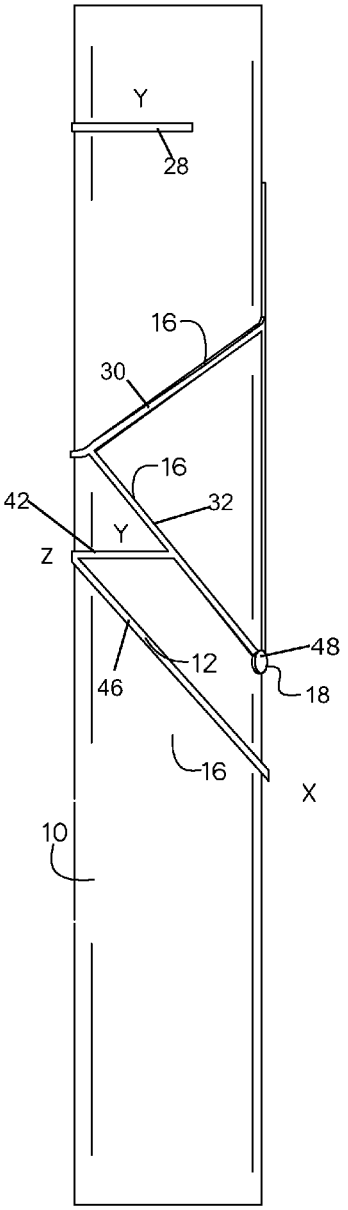
FIG. 6 is a side view of the present invention.
Figure 7:
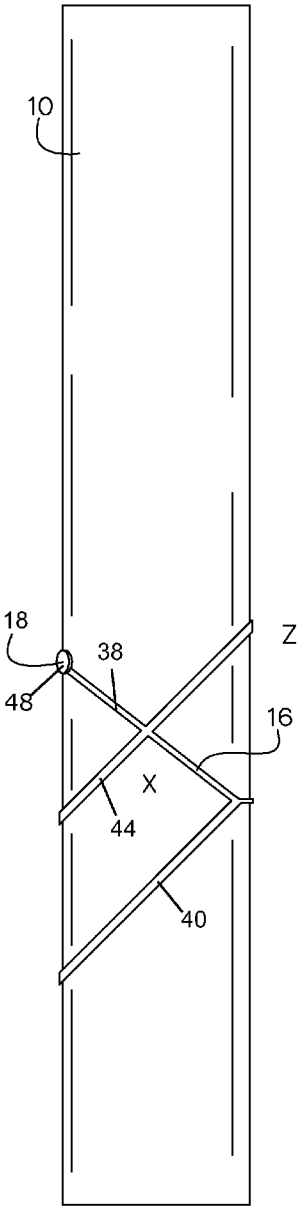
FIG. 7 is a side view of the present invention.

Referring to FIGS. 1 through 7, the present invention includes a golf putter grip 10. The golf putter grip 10 has a top end, a bottom end, a substantially flat front portion, a substantially curved rear portion, a first side, and a second side. The first and second sides are in between the front portion and the rear portion. The present invention may further include a pattern disposed on the golf putter grip 10 that aids the golfer in perfecting the golf putter swing.

In certain embodiments, the pattern may include a top triangle 24 and a bottom triangle 26 disposed on the front portion. The top triangle 24 and the bottom triangle 26 each include a bottom and a pair of sides extending from the bottom and intersecting at a top point. The bottoms of the triangles 24, 26 may be substantially parallel relative to one another. The sides of the top and bottom triangle 24, 26 may be curved.

The pattern of the present invention may further include a top line 28 extending from the first side to the rear side. In certain embodiments, the top line 28 may be aligned near the top point of the top triangle 24.

The pattern of the present invention may further include a first diagonal line 30 and a second diagonal line 32. The first diagonal line 30 may extend from the bottom side of the top triangle 24 extending onto the first side of the grip 10. The second diagonal line 32 may extend from the bottom side of the bottom triangle 26 on to the first side of the grip 10 and intersect with the first diagonal line 30.

The pattern of the present invention may further include a first middle line 34 and a bottom line 36. The first middle line 34 may extend from the intersection of the first diagonal line 30 and the second diagonal 32 line and may be disposed on the rear portion. The first middle line 34 may be substantially parallel with the top line 28. The bottom line 36 is disposed on the rear portion below and substantially parallel with the first middle line 34.

In certain embodiments, the pattern may include a third diagonal line 38 and a fourth diagonal line 40. The third diagonal line 38 may extend from the bottom side of the bottom triangle 26 and extend onto to the second side of the grip 10. The fourth diagonal line 40 may be disposed on the second side extending from the bottom end towards the top end of the grip 10 and intersecting with the third diagonal line 38. In certain embodiments, bottom line 36 extends from the intersection of the fourth diagonal line 40 and the third diagonal line 38.

In certain embodiments, the pattern of the present invention may further include a second middle line 42 disposed on the rear portion in between the first middle line 34 and the bottom line 36. A first and second middle diagonal line 44, 46 may extend from the second middle line 42 towards the bottom end and away from one another. In certain embodiments, the first middle diagonal line 44 intersects with the third diagonal line 38 on the second side, and the second middle diagonal line 46 extends on the first side. In certain embodiments, the second middle line 42 extends passed the second middle diagonal line 46 and intersects with a midpoint of the second diagonal line 32.

The pattern of present invention may further include a plurality of dots 48. A dot 48 may be disposed at the top point of the top triangle 24, and the bottom corners and the top point of the bottom triangle 26.

The second middle diagonal line 46, the bottom line 36 and the first middle line 34 may be a first color (gold). The first diagonal line 30, the second diagonal line 32, and the third diagonal line 38 may be a second color (green) and the top triangle and the bottom triangle may be a third color 18 (purple). The dot 48 on the top triangle 24 may be the first color 12 (gold), and the dots 48 on the bottom triangle 26 may be the third color 18 (purple).

The thumbs may be placed on the two curved triangles 24, 26 on the front portion, with the bottom thumb flexed and the top thumb extended. These thumbs may be connected to the double pendulum mechanism of putting, with the top thumb associated with the bottom pendulum and the bottom thumb associated with the top pendulum The grip pattern also provides specific landmarks for both index fingers which along with the thumbs are aligned in a specific manner along the X, Y and Z planes. There are also guide lines that connect to the coracoid process of the front shoulder and the iliac crest of the front hip and thru the main plane of the putting stroke that goes through the umbilicus, the front fifth toe, the front coracoid process and the front iliac crest anterior edge.

The rear portion X line is aligned with the ulnar edge of the back palm (along the little finger). The front portion X line is aligned with the ulnar edge of index finger (the edge adjacent finger). The Y lines are aligned to the distal phalanx (tip) of index finger. The Z line is aligned to base of back little finger and middle segment of front index finger. The triangles are aligned to the tendons of the index and middle finger on the back of both hands with the base of the triangles (the edge aligned to base of the two domes on the top surface is aligned to the base of the two index fingers). The golden and purple segment of the two triangles are aligned to the pulp of the distal phalanx of the two thumbs along outer (radial) edge. These points of contact are stable with constant pressure throughout the swing.

There are three pendulums involved in the putting stroke. There is a larger pendulum that extends throughout the entire stroke - that is aligned to X lines (and the X plane) that is controlled by the large muscles i.e. the deltoids, the biceps and the gluteals of the back side (left side in left handed golfer). There is a smaller pendulum for the back swing that is aligned to the Z line (and the Z plane) which is controlled by the elbows. There is another small pendulum that is aligned to the Y lines and Y plane that is controlled by the axial muscles of the hips (pelvic girdle). The fulcrum of the pendulums is at the front hip joint. The distance between the tip of the front index finger (top of back Y line) and the bottom of the spine angle where it meets the ground is constant throughout the stroke. The distance between the tip of the back index finger (bottom of front Y line) and the eyes/top of the spine angle is also constant.

The lines of the present invention may be replaced by dots at important junctions, but the outline of the pattern remains essentially the same. The present invention can be a grip pattern that can be transferred to existing putters using a transfer tape technique or other similar method or etched on a new putter during the manufacturing process. The size of the grip and the pattern may be determined by the hand, thumb and finger size of the player.

It should be understood, of course, that the foregoing relates to exemplary embodiments of the invention and that modifications may be made without departing from the spirit and scope of the invention as set forth in the following claims.

What is claimed is:

1. An apparatus comprising:

a golf putter grip having a top end, a bottom end, a substantially flat front portion, a substantially curved rear portion, a first side, and a second side, wherein the first and second sides are in between the front portion and the rear portion; and a pattern disposed on the golf putter grip, wherein the pattern comprises:

a top triangle and a bottom triangle disposed on the front portion, wherein the top triangle and the bottom triangle each comprise a bottom and a pair of sides extending from the bottom and intersecting at a top point, wherein the bottoms are substantially parallel relative to one another;

a top line extending from the first side to the rear portion, aligned near the top point of the top triangle;

a first diagonal line extending from the bottom side of the top triangle extending onto the first side;

a second diagonal line extending from the bottom side of the bottom triangle and extending on to the first side, intersecting with the first diagonal line;

a first middle line extending from the intersection of the first diagonal line and the second diagonal line and disposed on the rear portion, wherein the first middle line is substantially parallel with the top line; and a bottom line disposed on the rear portion below and substantially parallel with the first middle line.

2. The apparatus of claim 1, wherein the pattern further comprises a third diagonal line extending from the bottom side of the bottom triangle and extending on to the second side.

3. The apparatus of claim 2, wherein the pattern further comprises a fourth diagonal line disposed on the second side extending from the bottom end towards the top end and intersecting with the third diagonal line, wherein the bottom line extends from the intersection of the fourth diagonal line and the third diagonal line.

4. The apparatus of claim 3, wherein the pattern further comprises a second middle line disposed on the rear portion in between the first middle line and the bottom line.

5. The apparatus of claim 4, further comprising a first and second middle diagonal line extending from the second middle line towards the bottom end and away from one another, wherein the first middle diagonal line intersects with the third diagonal line on the second side, and the second middle diagonal line extends on the first side.

6. The apparatus of claim 5, wherein the second middle line extends passed the second middle diagonal line and intersects with a midpoint of the second diagonal line.

7. The apparatus of claim 1, wherein the pattern further comprises a plurality of dots, wherein each dot is disposed at the top point of the top triangle, and the bottom corners and the top point of the bottom triangle.

8. The apparatus of claim 1, wherein the sides of the top and bottom triangle are curved.

* * * * *